US007882602B2

(12) United States Patent
Himi

(10) Patent No.: US 7,882,602 B2
(45) Date of Patent: Feb. 8, 2011

(54) SLIDE FASTENER WITH SEPARABLE BOTTOM END STOP

(75) Inventor: Naoyuki Himi, Toyama-ken (JP)

(73) Assignee: YKK Corporation, Tokyo (JP)

( * ) Notice: Subject to any disclaimer, the term of this patent is extended or adjusted under 35 U.S.C. 154(b) by 617 days.

(21) Appl. No.: 11/891,932

(22) Filed: Aug. 14, 2007

(65) Prior Publication Data

US 2008/0040901 A1 Feb. 21, 2008

(30) Foreign Application Priority Data

Aug. 17, 2006 (JP) ..... 2006-222674

(51) Int. Cl.
*A44B 19/38* (2006.01)

(52) U.S. Cl. ..... 24/433; 24/434

(58) Field of Classification Search ..... 24/388, 24/433, 434, 435, 436
See application file for complete search history.

(56) References Cited

U.S. PATENT DOCUMENTS

| | | | | |
|---|---|---|---|---|
| 2,193,827 | A * | 3/1940 | Marinsky | 24/388 |
| 3,964,136 | A | 6/1976 | Panzeri | |
| 4,078,279 | A * | 3/1978 | Heimberger | 24/434 |
| 4,221,026 | A * | 9/1980 | Kanzaka | 24/433 |
| 4,233,099 | A * | 11/1980 | McGuire | 156/242 |
| 4,742,603 | A * | 5/1988 | Kasai | 24/433 |
| 5,333,362 | A * | 8/1994 | Gillioz | 24/433 |
| 6,088,888 | A * | 7/2000 | Oda | 24/433 |
| 6,604,262 | B2 * | 8/2003 | Wang | 24/388 |
| 6,826,810 | B2 * | 12/2004 | Ichikawa et al. | 24/433 |
| 2005/0050699 | A1 | 3/2005 | Yoneoka | |

FOREIGN PATENT DOCUMENTS

| | | |
|---|---|---|
| DE | 25 10 098 | 9/1975 |
| DE | 26 03 241 | 8/1977 |
| DE | 10 2004 006314 | 9/2004 |
| EP | 0 051 219 | 5/1982 |
| JP | Y2-59-25227 | 7/1984 |

OTHER PUBLICATIONS

Extended Search Report dated Nov. 20, 2009, European Application No. 07015103.0-2314.

* cited by examiner

*Primary Examiner*—Victor Batson
*Assistant Examiner*—Rowland D Do
(74) *Attorney, Agent, or Firm*—Alston & Bird LLP

(57) ABSTRACT

A slide fastener with a separable bottom end stop, which can be handled easily by everyone and closed or separated easily. The slide fastener includes a slider through which fastener element rows of a pair of right and left fastener tapes pass; and a separable bottom end stop including a fitting body provided on one of the fastener tapes and a pivot stopper body provided on the other fastener tape and being capable of engaging with the fitting body. The pivot stopper body has a pivot stopper portion which is capable of rotatably engaging with the fitting body by fitting the fitting body in the pivot stopper portion from a side portion of the pivot stopper body and capable of rotatably engaging with the fitting body by inserting the fitting body in the pivot stopper portion through an element guide passage from a shoulder mouth of the slider.

8 Claims, 10 Drawing Sheets

SLIDE FASTENER WITH SEPARABLE BOTTOM END STOP

BACKGROUND OF THE INVENTION

1. Field of the Invention

The present invention relates to a slide fastener with a separable bottom end stop placed at end portions of right and left fastener tapes, and more particularly, to a slide fastener with a separable bottom end stop comprising a fitting body and a pivot stopper body and having a structure capable of engaging the fitting body with the pivot stopper body according to two ways of engagement operations.

2. Description of Related Art

Conventionally, as a separable bottom end stop of the slide fastener, there has been known a side open type separable bottom end stop which allows a fitting body formed on one of a pair of right and left fastener stringers to be inserted and engaged with an engaging body formed on the other fastener stringer from a side portion of the engaging body without passing of the fitting body through an element guide passage in a slider. Further, for example, Japanese Utility Model Application Publication (JP-Y) No. 59-25227 has disclosed an invention relevant to this kind of side open type separable bottom end stop.

In the side open type separable bottom end stop disclosed in the JP-Y-59-25227, the engaging body and the fitting body of the separable bottom end stop are fixed to end portions of right and left element rows so that they oppose each other. The engaging body comprises: a slider holding portion which is formed on both front and rear surfaces of the fastener tape to hold the slider; a fitting portion, which is formed thicker than the slider holding portion on a tape end side of the slider holding portion and engages with the fitting body; a recessed groove, which is formed in the side face of the slider holding portion and in an inner side face of the fitting portion; and a projection projecting from the intermediate portion of the recessed groove. The fitting portion includes a supporting hole formed in an inverted L shape from the side face of the fitting body side toward a central portion of the fitting portion such that it penetrates through the front and rear surfaces of the fitting portion, the supporting hole having an inverted C shape as seen in its front view.

The fitting body has a fitting plate portion formed in such a thickness as to fit to the recessed groove possessed by the engaging body, and a recessed portion of a shape corresponding to the projection on the engaging body side face of the fitting plate portion. The tape end side of the fitting plate portion is provided with a thicker swollen portion than the fitting plate portion. The swollen portion has a supporting pin projecting to both the tape front and rear surfaces.

Right and left fastener stringers in the slide fastener with a separable bottom end stop of side open type having the above-described configuration are closed as follows. After the slider is slid to a position which makes contact with the fitting portion of the engaging body and brought into contact therewith, the supporting pin of the fitting body is inserted into the supporting hole in the engaging body. At this time, the supporting pin of the fitting body is supported stably at an end portion of the supporting hole because the fitting portion of the engaging body has an inverted C shape. Next, the fitting body whose supporting pin is inserted into the supporting hole is rotated toward the engaging body around the supporting pin, whereby the fitting plate portion of the fitting body is inserted into the slider through an interval between the upper and lower flanges of the slider. Consequently, the right and left element rows are positioned so as to enable stable engagement. Thereafter, by sliding the slider in an element engagement direction (by pulling up), right and left element rows are engaged with each other so as to close the slide fastener.

The separating operation is performed as follows in the slide fastener with a separable bottom end stop of side open type. The slider is slid toward the separable bottom end stop and brought into contact with the fitting portion of the engaging body, and then, the fitting body is rotated around the supporting pin in a direction that it departs from the engaging body. Consequently, the fitting plate portion of the fitting body is released from the slider. Further, when the supporting pin of the fitting body is pulled out of the supporting hole in the engaging body, the right and left fastener stringers are separated from each other.

The slide fastener with a separable bottom stop end of side open type has the following advantageous effects. By inserting the supporting pin of the fitting body into the supporting hole formed in the engaging body to rotate the fitting body or by pulling out the supporting pin inserted into the supporting hole from the engaging body, the right and left fastener stringers can be positioned and separated. Thus, the aforementioned slide fastener does not require an operation of inserting an insert pin through the interior of the slider when fitting the insert pin into a box of a slide fastener with an ordinary separable bottom end stop comprising the insert pin, box pin and box. This improves operability of the separable bottom end stop, so that the right and left fastener stringers can be closed or separated very easily.

Accordingly, the side open type separable bottom end stop can be applied to for example, a product in which the operation of the slide fastener is required to be done with a single hand, a product in which the operation of the slide fastener is performed by groping because the position of the separable bottom end stop cannot be recognized directly, or a product in which the operation of the slide fastener is required in an environment which is not suitable for a delicate work.

The side open type separable bottom end stop described in the JP-Y-59-25227 allows closing operation and separation operation of the slide fastener to be carried out more easily than an ordinary separable bottom end stop comprising the insert pin, box pin and box and secures excellent availability. However, the side open type separable bottom end stop is completely different from the ordinary separable bottom end stop comprising the insert pin and the like in terms of operation methods for engagement and pulling out, and has not been recognized highly or known well by users.

Thus, although the slide fastener having the side open type separable bottom end stop is easy to operate for closing or separation, a user accustomed to the ordinary separable bottom end stop having the insert pin and the like sometimes feels trouble in the operation of the side open type separable bottom end stop. Therefore, until the user becomes accustomed to the operation of the side open type separable bottom end stop, the user sometimes tries to insert the fitting body into the slider when engaging the fitting body with the engaging body or sometimes tries to pull the fitting body strongly toward the slider when pulling out the fitting body from the engaging body. For this reason, availability thereof is worsened further.

SUMMARY OF THE INVENTION

The present invention has been achieved in views of the conventional problem, and an object of the invention is to provide a slide fastener with a separable bottom end stop which can be used easily by everyone, allowing user to carry out its closing operation and separation operation easily by improving ease of use of the separable bottom end stop.

To achieve the above object, according to the present invention, there is provided a slide fastener with a separable bottom end stop, including a slider through which fastener element rows pass, the fastener element rows mounted on opposing side edges of a pair of right and left fastener tapes; and a separable bottom end stop including a fitting body which is provided at an end portion of the fastener element row of one of the fastener tapes and has a to-be-pivoted portion, and a pivot stopper body which is provided on an end portion of the fastener element row of the other fastener tape, is capable of engaging with or disengaging from the to-be-pivoted portion of the fitting body, and functions as a bottom end stop of the slider. The slider has a guide post, an upper blade plate and a lower blade plate connected by the guide post, flange portions erected from right and left side edges of the upper blade plate and/or the lower blade plate, and a Y-shaped element guide passage which is surrounded by the upper blade plate, the lower blade plate and the flange portions and is branched to two sections by the guide post from a rear mouth to a shoulder mouth of the slider. The pivot stopper body has a pivot stopper portion which is capable of rotatably engaging the to-be-pivoted portion by fitting the to-be-pivoted portion in the pivot stopper portion from a side portion of the pivot stopper body and capable of rotatably engaging with the to-be-pivoted portion by inserting the to-be-pivoted portion in the pivot stopper portion through the element guide passage from the shoulder mouth of the slider.

In the slide fastener with a separable bottom end stop of the invention, preferably, the fitting body has a thin fitting plate portion which is formed integrally on both front and rear surfaces of one of the fastener tapes and which has the to-be-pivoted portion arranged at a tape end side front portion of the fitting plate portion, and the pivot stopper body has a slider holding portion which is formed integrally on both front and rear surfaces of the other fastener tape to hold the slider. The pivot stopper portion is formed so as to be thick on a tape end side of the slider holding portion via a step portion; includes a substantially J-shaped inner face which is extended from the slider holding portion to the tape end side and curved toward a side of the fitting body and a pivot space which allows the to-be-pivoted portion to be fitted into the substantially J-shaped inner face from a side portion of the pivot stopper body; and is capable of engaging with the to-be-pivoted portion to the substantially J-shaped inner face. The thickness of the to-be-pivoted portion in the tape front-rear surface direction is set smaller than an interval in the height direction of the element guide passage of the slider while the thickness of the fitting plate portion is set smaller than the interval of a gap provided on the flange portion of the slider.

In the slide fastener of the invention, preferably, the to-be-pivoted portion has a cylindrical pivot shaft provided projectingly in a tape front-rear surface direction from the fitting plate portion. The to-be-pivoted portion may be formed in a circular shape such that it is flush with front and rear surfaces of the fitting plate portion.

In the invention, preferably, a fitting plate portion engagement groove which allows the fitting plate portion to be fitted therein is formed in a side face of the slider holding portion opposing the fitting plate portion. Further, it is preferable that the fitting plate portion engagement groove is formed in part of the substantially J-shaped inner face of the pivot stopper portion.

Further, a to-be-pivoted portion engagement groove which allows the to-be-pivoted portion to be fitted therein may be formed in the substantially J-shaped inner face of the pivot stopper portion, and the to-be-pivoted portion engagement groove may constitute the pivot space.

Preferably, the pivot stopper portion has a slit which penetrates from the substantially J-shaped inner face to an outer peripheral face, and a groove width of the slit is set larger than a thickness of the fitting plate portion. It is also preferable that the fitting plate portion has a notch portion which is cut from a tape end side of the fitting plate portion toward an inward of the tape.

In the slide fastener with separable bottom end stop of the present invention, as described above, the pivot stopper body of the separable bottom end stop has the pivot stopper portion capable of engaging the to-be-pivoted portion of the fitting body by fitting from the side portion of the pivot stopper body and capable of engaging the to-be-pivoted portion of the fitting body by inserting through the element guide passage from the shoulder mouth of the slider. In the slide fastener of the present invention, with the slider held on the pivot stopper body and the to-be-pivoted portion of the fitting body engaged with the pivot stopper body, the fitting body is inserted into the element guide passage through the flange portions of the slider. Thereafter, right and left fastener element rows are engaged with each other by sliding the slider. Thus, the slide fastener of the present invention is so constructed to be capable of executing two different kinds of engagement operations. The operating include a first engagement operation of engaging the to-be-pivoted portion of the fitting body with the pivot stopper body by fitting from the side portion of the pivot stopper body, and a second engagement operation of engaging the to-be-pivoted portion of the fitting body with the pivot stopper body by inserting through the element guide passage of the slider.

In the conventional slide fastener with a separable bottom end stop, its separable bottom end stop is formed to execute only one kind of the engagement operation and disengagement operation, and thus, the separable bottom end stop cannot be engaged or disengaged by two different kinds of operations. Conventionally, there has been no idea of constructing the separable bottom end stop, which enables engagement or disengagement of the separable bottom end stop by two kinds of operations.

Contrary to this, the slide fastener with a separable bottom end stop of the present invention is constructed as follows. That is, not only the to-be-pivoted portion of the fitting body of the conventional open side type separable bottom end stop is engaged with the pivot stopper portion by fitting from the side portion of the pivot stopper portion, but also, like an ordinary separable bottom end stop having an insert pin and the like, the to-be-pivoted portion of the fitting body can be engaged with the pivot stopper portion by inserting through the element guide passage from the shoulder mouth of the slider. Consequently, a user who uses the slide fastener with a separable bottom end stop of the present invention can arbitrarily select the first engagement operation and the second engagement operation to engage the fitting body with the pivot stopper body in order to close the slide fastener.

Assume that, when using the slide fastener with a separable bottom end stop of the present invention, the user is not accustomed to operation of the side open type separable bottom end stop. In this case, he or she can close the slide fastener smoothly without any trouble in operation of the separable bottom end stop by executing the second engagement operation of engaging the to-be-pivoted portion of the fitting body into the pivot stopper portion by inserting through the interior of the slider. Further, when he or she is accustomed to operation of the side open type separable bottom end stop or becomes accustomed, he or she can close the slide fastener easily by executing the first engagement operation of engaging the to-be-pivoted portion of the fitting body with the pivot stopper portion by fitting from the side portion of the pivot stopper body.

When separating the slide fastener also, the user can arbitrarily select any one of the two different kinds of operations for pulling out the separable bottom end like in the engagement operation. Therefore, the slide fastener with a separable bottom end stop of the present invention has been improved in terms of ease of use of the separable bottom end stop as compared with the conventional slide fastener with the side open type separable bottom end stop or a slide fastener with ordinary separable bottom end stop having the insert pin and the like, and excellent in availability and operability, so that everyone can handle the slide fastener of the invention easily.

In the slide fastener with a separable bottom end stop of the present invention, the fitting body is formed on both the front and rear surfaces of the fastener tape and has the thin fitting plate portion in which the to-be-pivoted portion is arranged at the tape end side front end. The pivot stopper body has the slider holding portion formed integrally on both the front and rear surfaces of the tape as well as the pivot stopper portion, and the pivot stopper portion has the substantially J-shaped inner face and pivot space which allow the to-be-pivoted portion of the fitting body to engage rotatably. The thickness in the tape front-rear surface direction of the to-be-pivoted portion is set smaller than the height of the element guide passage of the slider, and the thickness of the fitting plate portion is set smaller than the interval of a gap provided on the flange portion of the slider. Because the fitting body and pivot stopper body of the present invention have the above-described configuration, the slide fastener of the present invention can secure a structure for engaging the to-be-pivoted portion of the fitting body with the pivot stopper body by the above-described different two engagement operations and disengaging the to-be-pivoted portion of the fitting body by the different two kinds of disengagement operations.

Because according to the present invention, the to-be-pivoted portion has the cylindrical pivot shaft provided projectingly from the fitting plate portion, the to-be-pivoted portion can be engaged with the pivot stopper portion stably by fitting from the side portion of the pivot stopper body when executing the first engagement operation. Further, the fitting body can be rotated smoothly around the pivot shaft toward the pivot stopper body. When executing the second engagement operation, the to-be-pivoted portion can be engaged with the pivot stopper portion by inserting through the interior of the slider stably.

The to-be-pivoted portion may have a structure formed circularly such that it is flush with the front and rear surfaces of the fitting plate portion instead of having the cylindrical pivot shaft provided projectingly from the fitting plate portion. When the first engagement operation is executed, the to-be-pivoted portion having such a configuration can be engaged by fitting from the side portion of the pivot stopper body and further, rotated smoothly around the to-be-pivoted portion toward the pivot stopper body. Moreover, also when the second engagement operation is executed, the to-be-pivoted portion can be engaged with the pivot stopper portion stably by insertion.

In the present invention, the fitting plate portion engagement groove is formed in a side face of the slider holding portion opposing the fitting plate portion, and further, the fitting plate portion engagement groove is formed also in part of the substantially J-shaped inner face of the pivot stopper portion. By fitting the fitting plate portion of the fitting body into the fitting plate portion engagement groove when engaging the fitting body with the pivot stopper body, the fitting plate portion can be guided to a predetermined position of the pivot stopper body stably. When the slide fastener is closed, the engagement state between the fitting body and the pivot stopper body can be stabilized. For this reason, even if the separable bottom end stop receives a force (pushing-up force) in the tape front-rear surface direction with the slide fastener closed, the fitting body of the separable bottom end stop can be prevented from going out of the pivot stopper body, thereby maintaining the engagement state stably. In the meantime, the fitting plate portion engagement groove may be formed continuously in the side face of the slider holding portion opposing the fitting plate portion and in part of the substantially J-shaped inner face of the pivot stopper portion or intermittently.

The to-be-pivoted portion engagement groove which allows the to-be-pivoted portion to be fitted therein, constituting the pivot space is formed in the substantially J-shaped inner face of the pivot stopper portion. With this configuration, the fitting body can be engaged with the pivot stopper body securely when executing the first and second engagement operations, so that the engagement state can be maintained stably.

Further, the slit is formed such that it penetrates from the substantially J-shaped inner face of the pivot stopper portion to the outer peripheral face and/or the notch portion is formed in the fitting plate portion. Accordingly, when the fitting body is engaged by fitting from the side portion of the pivot stopper body, interference between the fitting body and the pivot stopper body can be prevented, thereby achieving the engagement operation of the separable bottom end stop smoothly.

DESCRIPTION OF THE PREFERRED EMBODIMENTS

Hereinafter, embodiments of the present invention will be described in detail with reference to the accompanying drawings. The present invention is not restricted to respective embodiments described below but may be modified in various ways as long as substantially the same configuration as the present invention is possessed and like operation and effect are exerted. In the embodiments, a slide fastener in which its fastener elements and separable bottom end stop are formed by injection molding synthetic resin has been described. However, the present invention is not restricted to this example but a slide fastener provided with coil-like fastener elements or metallic separable bottom end stop on a fastener tape thereof may be adopted.

First Embodiment

Figure 1:
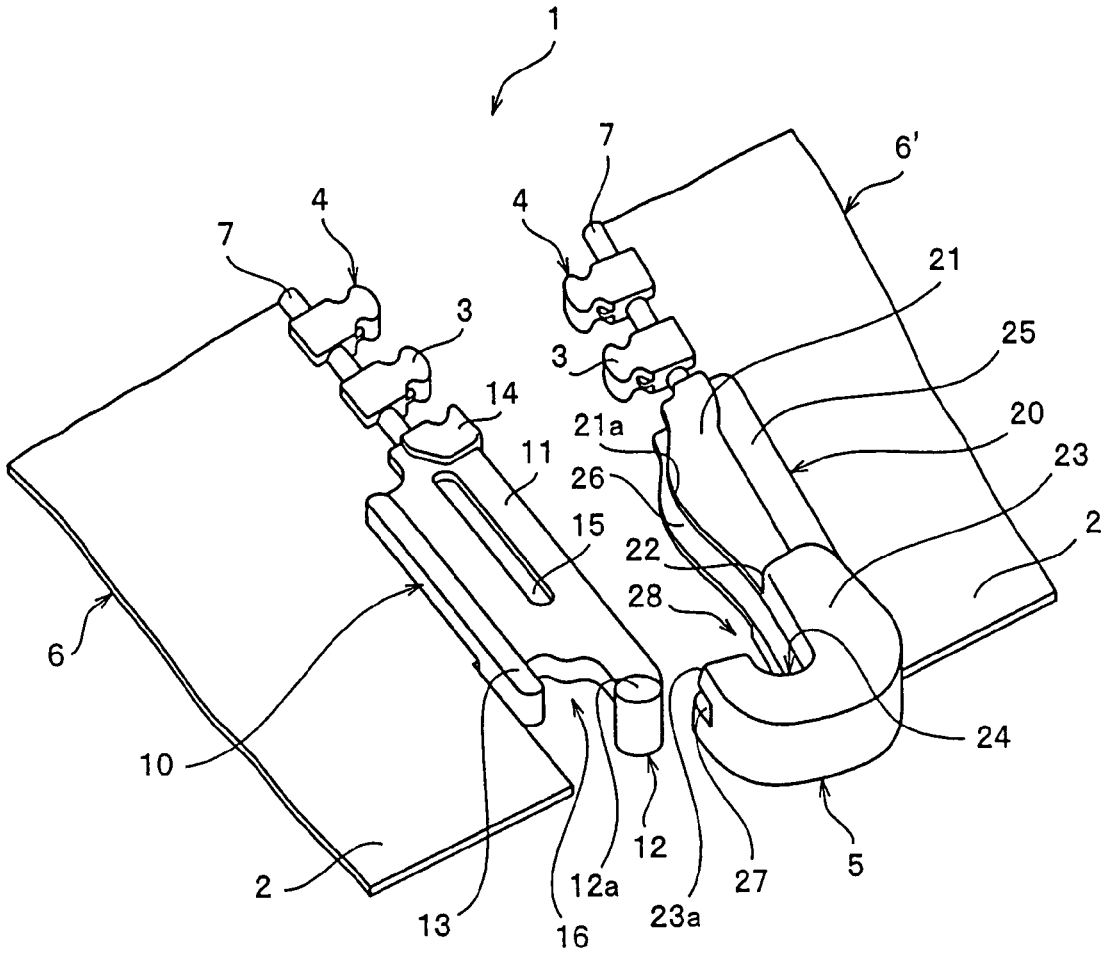
FIG. 1 is a perspective view showing major portions of a separable bottom end stop mounting portion of a slide fastener with a separable bottom end stop according to a first embodiment.

FIG. 1 is a perspective view showing major portions of a separable bottom end stop attaching portion of a slide fastener with a separable bottom end stop according to a first embodiment of the present invention. In the following description, in order to explain the present invention to facilitate understanding thereof, a direction of sliding a slider 30 along the tape longitudinal direction so as to close the slide fastener 1 is specified as forward and the direction of sliding the slide fastener 1 so as to separate the slide fastener 1 is specified as backward, on the basis of the slide fastener 1 shown in FIG. 1. Further, if the slide fastener 1 is seen from the front side, a side in which a fitting body 10 of the separable bottom end stop 5 is formed in the width direction of the fastener tape 2 is specified as leftward and a side in which a pivot stopper body 20 is formed is specified as rightward.

As shown in FIG. 1, the slide fastener 1 with a separable bottom end stop of the first embodiment comprises a pair of right and left fastener tapes 2, fastener elements 3 provided in line on opposing side edges of the right and left fastener tapes 2, a separable bottom end stop 5 provided at one end portion of a fastener element row 4 and the slider 30 (not shown in FIG. 1).

The fastener tapes 2 have a core thread portion 7 on opposing side edges thereof, and a plurality of fastener elements 3 are arranged at specified intervals along element mounting edges including the core thread portion 7 of the fastener tape 2 so as to form the fastener element row 4. The fastener element 3 is comprised of a body portion to be fixed to the fastener tape 2, a neck portion extending outward form the body portion, and an expanded coupling head provided at the front end of the neck portion. The fastener elements 3 may be mounted on the fastener tape 2 by injection molding a synthetic resin material such as polyacetal used generally since before into a predetermined shape.

As the slider 30, a conventionally generally known one may be used. The slider 30 includes, for example, an upper blade plate 31*a*, a lower blade plate 31*b*, upper and lower flanges 32*a*, 32*b* arranged perpendicularly along right and left ends of the upper blade plate 31*a* and lower blade plate 31*b*, a guide post 33 stood to join the front end side central portion of the upper blade plate 31*a* with the front end side central portion of the lower blade plate 31*b*, and a pull tab 34 attached to the upper blade plate 31*a*. The slider 30 has a rear mouth on its rear end side and shoulder mouths on both right and left sides of the guide post 33 on the front end side of the slider 30. An element guide passage 35 surrounded by the upper and lower flanges 32*a*, 32*b* and the upper and lower blade plates 31*a*, 31*b* is formed inside the slider 30. The element guide passage 35 is branched to two sections by the guide post 33 such that it extends through the interior of the slider 30 from the rear mouth to the shoulder mouths in a letter Y shape. In the slider 30 of the present invention, the flanges may be stood on both the right and left side edges of any one of the upper blade plate 31*a* and the lower blade plate 31*b*.

The separable bottom end stop 5 has the fitting body 10 and pivot stopper body 20 made of a synthetic resin such that they are continuous from the fastener element row 4 at the bottom ends of the right and left fastener tapes 2.

The fitting body 10 is comprised of thin fitting plate portion 11 formed integrally on both front and rear surfaces of the one fastener tape 2 (left side), a to-be-pivoted portion 12 formed at a tape end side front end portion (rear end portion) of the fitting plate portion 11, a projecting portion 13 formed along the tape inside side edge of the fitting plate portion 11, a coupling portion 14 formed continuous from the fastener element row 4 at the front end portion of the fitting plate portion 11, and a recess portion 15 formed at portions of front and rear surfaces corresponding to the core thread portion 7 of the fitting plate portion 11.

In the first embodiment, the tape end portion of the left side fastener tape 2 having the fitting body 10 is cut out partially, and the fitting plate portion 11 is provided at the notch portion of the fastener tape 2 such that it extends rearward. The fitting plate portion 11 is flat on both the front and rear surfaces except the recess portion 15, and the thickness of the tape in the direction from the front surface to the rear surface is set smaller than the interval of a gap formed between the upper and lower flanges 32*a*, 32*b* of the slider 30. The fitting plate portion 11 has a notch portion 16 which is cut inward of the tape (forward) from the tape end portion side.

The to-be-pivoted portion 12 has a cylindrical pivot shaft 12*a* which is provided projectingly from the front and rear surfaces of the fitting plate portion 11 at the extended portion of the fitting plate portion 11. The pivot shaft 12*a* is formed smaller in its thickness in the direction from the front surface to the rear surface of the tape than an interval in the height direction of the element guide passage 35 inside the slider 30, that is, an interval between the upper blade plate 31*a* and the lower blade plate 31*b* of the slider 30, while it is formed larger in its thickness in the direction from the front surface to the rear surface of the tape than the interval between the upper and lower flanges 32*a*, 32*b*.

The projecting portion 13 is formed thicker than the fitting plate portion 11. Because the thick projecting portion 13 is formed along the tape inside side edge, the strength of the fitting body 10 can be improved. Further, the fitting body can be formed into such a shape that a user operating the separable bottom end stop 5 can grip easily.

The recess portion 15 can be formed stably in the fitting body 10 and it is formed at a position corresponding to the core thread 7 in order to form the fitting plate portion 11 flat. More specifically, the core thread portion 7 of the fastener tape 2 is thicker than the fastener tape 2. For this reason, when the flat fitting plate portion 11 is formed by molding a synthetic resin at a portion in which the core thread portion 7 is formed, the fitting plate portion 11 formed on the core thread portion 7 is very thin. If the thickness of the fitting plate portion 11 is locally reduced, it can be considered that such a fault as worsening of resin flow at a thin portion of the fitting plate portion 11 when the fitting body 10 is injection-molded or failure of obtaining a sufficient strength occurs. However if the recess portion 15 is formed, the thin portion formed in the fitting plate portion 11 is reduced. As a result, the above-mentioned fault can be blocked effectively.

The pivot stopper body 20 of the separable bottom end stop 5 includes a slider holding portion 21, a pivot stopper portion 23, a reinforcement portion 25, a fitting plate portion engagement recessed groove 26, and a slit 27. The slider holding portion 21 is formed on both front and rear surfaces of the other fastener tape 2. The pivot stopper portion 23 is formed thicker than the slider holding portion 21 via a step portion 22, and has a substantially J-shaped inner face 24 and a pivot space 28. The reinforcement portion 25 is formed inward of the tape relative to the slider holding portion 21 in order to intensify the strength of fixing of the pivot stopper body 20 to the fastener tape 2. The fitting plate portion engagement recessed groove 26 is formed in part of the side face of the slider holding portion 21 opposing the fitting plate portion 11 and the substantially J-shaped inner face 24. The slit 27 penetrates through form the substantially J-shaped inner face 24 to an outer peripheral face of the pivot stopper portion 23. In the meantime, the fitting plate portion engagement recessed groove 26 may be formed on only the side face of the slider holding portion 21 opposing the fitting plate portion 11 in accordance with the shape of the fitting plate portion 11 because it engages the fitting plate portion 11 of the fitting body 10 when closing the slide fastener 1.

The thickness of the slider holding portion 21 in the direction from the front surface to the rear surface of the tape is smaller than the height of the element guide passage 35 inside the slider 30 and larger than the gap between the upper and lower flanges 32*a*, 32*b*. An intermediate portion 21*a* of the fitting body opposing side edge of the slider holding portion 21 is curved such that it is expanded slightly toward the fitting body 10. Further, when the slider 30 is brought into a contact with the step portion 22 by sliding as described later (see FIG. 2), the slider holding portion 21 can hold the slider 30 such that it is inserted into the element guide passage 35 in the slider 30.

In the first embodiment, the pivot stopper portion 23 is thicker than the slider holding portion 21 via the step portion 22 and extended from the slider holding portion 21 up to the tape end portion, so that the pivot stopper portion 23 is formed curvedly from the tape end portion to the fitting body 10 side. Thus, the pivot stopper portion 23 has a substantially J shape as seen in plan view. The pivot stopper portion 23 includes the pivot space 28 and the substantially J-shaped inner face 24. The pivot space 28 is open upward so that the to-be-pivoted portion 12 of the fitting body 10 can be fitted from the side portion of the pivot stopper body 20. The substantially J-shaped inner face 24 holds the to-be-pivoted portion 12 fitted to this pivot space 28 in contact therewith so that the to-be-pivoted portion 12 engages rotatably. The substantially J-shaped inner face 24 extends from the slider holding portion 21 to the tape end portion side and is curved toward the fitting body 10 side. The curvature radius of the curved portion in the substantially J-shaped inner face 24 is substantially equal to the radius of the to-be-pivoted portion 12 of the fitting body 10.

The slit 27 is formed in a curved portion side front end 23*a* of the pivot stopper portion 23 such that it penetrates through the outer peripheral face of the pivot stopper portion 23 from the substantially J-shaped inner face 24. The width in the direction from the front surface to the rear surface of the tape of this slit 27 is set larger than the thickness of the fitting plate portion 11 for allowing the fitting plate portion 11 of the fitting body 10 to be inserted therein.

Next, an operation of closing/separating the slide fastener 1 of the first embodiment having the separable bottom end stop 5 described above will be described below.

First, description will be given to a first engagement operation of engaging the fitting body 10 of the separable bottom end stop 5 with the pivot stopper body 20 by fitting from the side portion of the pivot stopper body 2, when closing the slide fastener 1.

Figure 2:
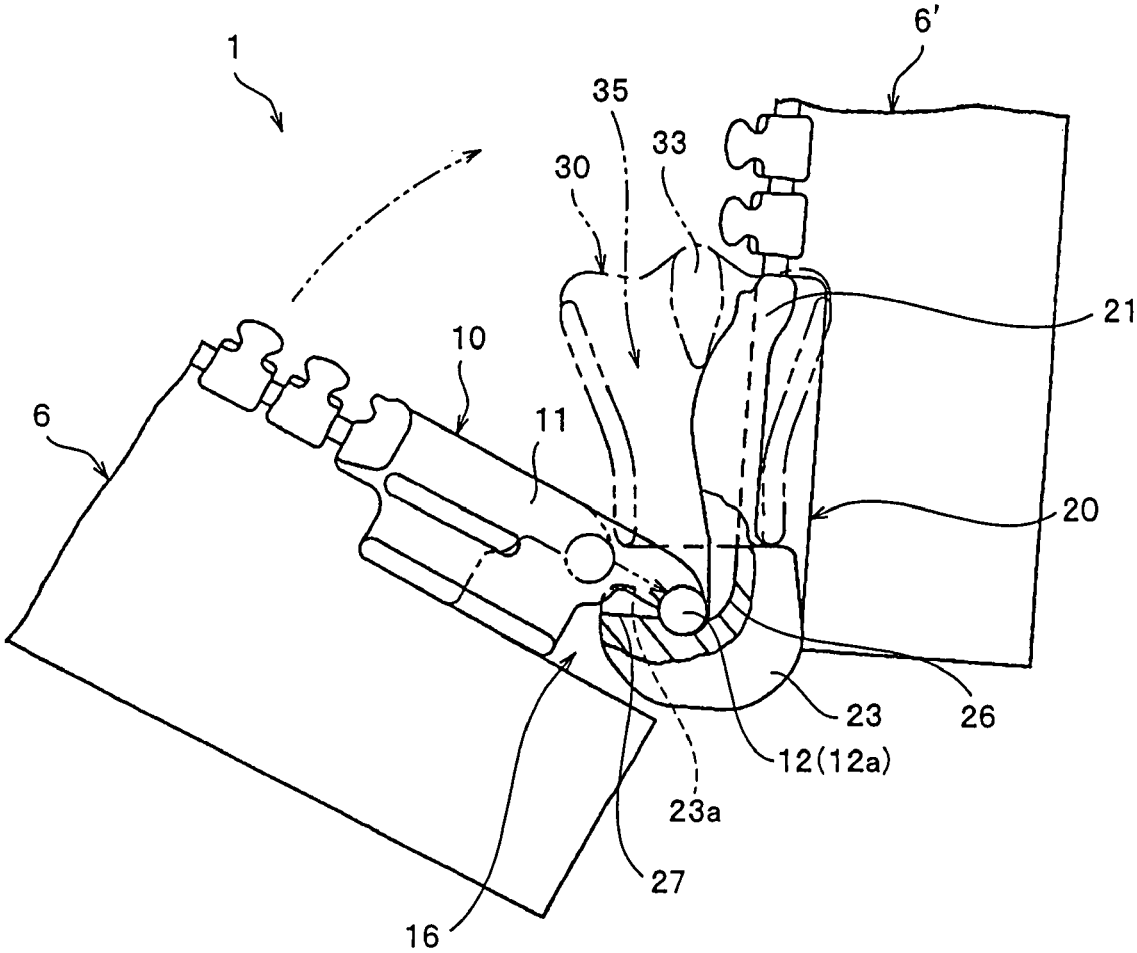
FIG. 2 is a front view schematically showing a state when a pivot shaft of a fitting body is engaged with a pivot stopper body by fitting the pivot shaft of the fitting body from sideway of the pivot stopper body in a first engagement operation of the slide fastener.

The first engagement operation is performed as follows. First, as shown in FIG. 2, the slider 30 is slid toward the pivot stopper body 20 mounted on the other (right side) fastener stringer 6' and brought into contact with the step portion 22 which serves as a bottom end stop. This operation allows the slider 30 to be held by the slider holding portion 21. In the meantime, in FIG. 2 and FIGS. 3, 5 and 8 described hereinbelow, the slider 30 is indicated with two-dot chain line while the fitting plate portion engagement recessed groove and slit of the pivot stopper portion are indicated with dotted line.

Next, the to-be-pivoted portion 12 of the fitting body 10 mounted on the fastener stringer 6 on one side (left) is fitted in the right direction from the left side of the pivot stopper body 20 to the pivot stopper portion 23 through a gap formed between the pivot stopper portion 23 and the slider 30 from the side portion of the pivot stopper body 20. As a consequence, the to-be-pivoted portion 12 can be guided into the pivot stopper portion 23 of the pivot stopper body 20 and brought into contact with the substantially J-shaped inner face 24. In the slide fastener 1 of this first embodiment, the notch portion 16 is formed in the fitting plate portion 11 of the fitting body 10, and the slit 27 is formed in the curved portion side front end 23*a* of the pivot stopper portion 23. The notch portion 16 is formed by cutting an area on the left side of the to-be-pivoted portion 12 upward from the end portion of the fastener tape 2, and the fastener tape 2 in the formation area of the notch portion 16 is also cut out, so that no fastener tape 2 extends in the notch portion 16. Consequently, the fitting plate portion 11 and the pivot stopper portion 23 do not interfere with each other, so that the to-be-pivoted portion 12 can be guided smoothly from the side portion of the pivot stopper portion 23 and as a result, an operation of fitting the to-be-pivoted portion 12 into the pivot stopper portion 23 can be carried out easily.

Figure 3:
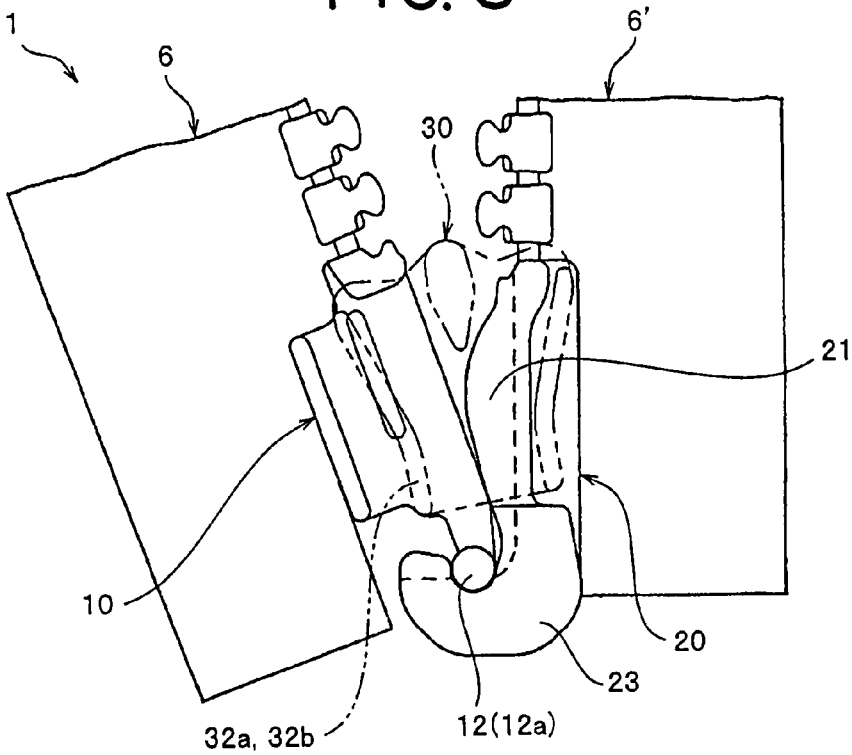
FIG. 3 is a front view schematically showing a state when a fitting plate portion is inserted in between upper and lower flanges of a slider in the first engagement operation of the slide fastener.

The to-be-pivoted portion 12 is engaged with the pivot stopper portion 23 of the pivot stopper body 20, and then, the fitting body 10 is rotated toward the pivot stopper body 20 around the to-be-pivoted portion 12. As shown in FIG. 3, the fitting plate portion 11 of the fitting body 10 is inserted in between the upper and lower flanges 32*a*, 32*b* of the slider 30 until it makes contact with the guide post 33 or it comes near the guide post 33. Consequently, the right and left fastener elements 4 are positioned so as to enable stable coupling.

Figure 4:
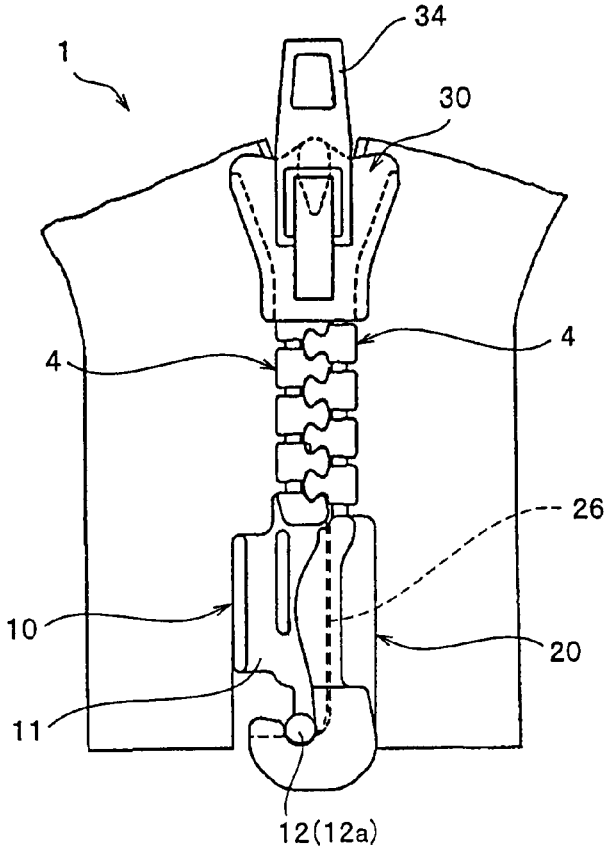
FIG. 4 is a front view schematically showing a closed state of the slide fastener with a separable bottom end stop according to the first embodiment.
Figure 5:
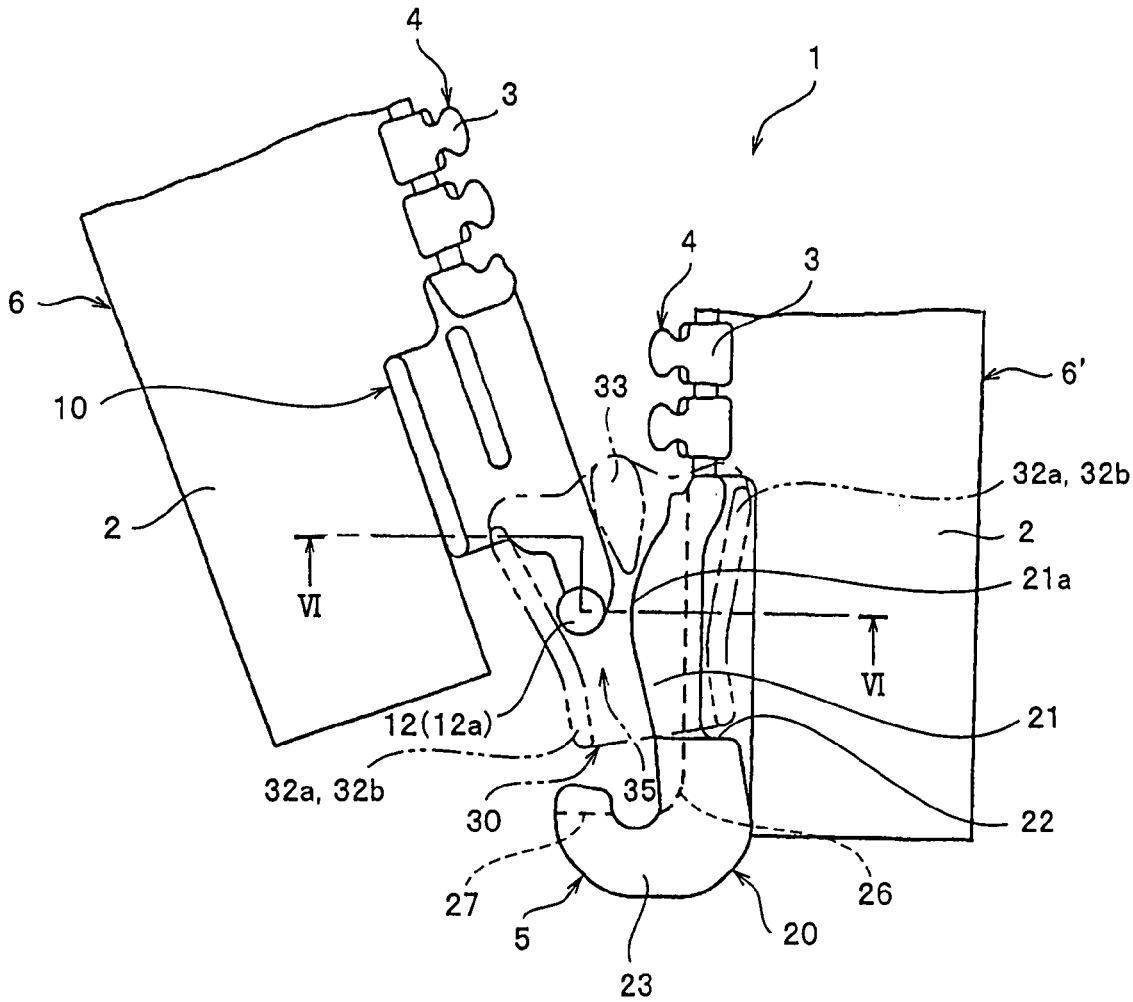
FIG. 5 is a front view schematically showing a state when the pivot shaft of the fitting body is inserted into an element guide passage of the slider in a second engagement operation of the slide fastener.

Thereafter, the slider 30 is slid upward with the fitting plate portion 11 inserted into the element guide passage 35 through the upper and lower flanges 32*a*, 32*b*. Thereby, as shown in FIG. 4, the fitting plate portion 11 of the fitting body 10 can be fitted into the fitting plate portion engagement groove 26 of the fitting body 20 and at the same time, the right and left fastener element rows 4 can be coupled with each other so as to close the slide fastener 1.

Next, description will be given to a second engagement operation of engaging the fitting body 10 of the separable bottom end stop 5 with the pivot stopper body 20 by inserting into the pivot stopper body 20 through the element guide passage 35 of the slider 30, when closing the slide fastener 1.

The second engagement operation is carried out as follows. First, the slider 30 is slid toward the pivot stopper body 20 mounted on the right side fastener stringer 6' and brought into contact with the step portion 22 like the first engagement operation. This operation allows the slider 30 to be held by the slider holding portion 21. At this time, a space which allows the to-be-pivoted portion 12 of the fitting body 10 to pass therethrough is created between the upper and lower flanges 32*a*, 32*b* located on the fitting body 10 side of the slider 30 and the slider holding portion 21 of the pivot stopper body 20 (see FIG. 5).

Figure 6:
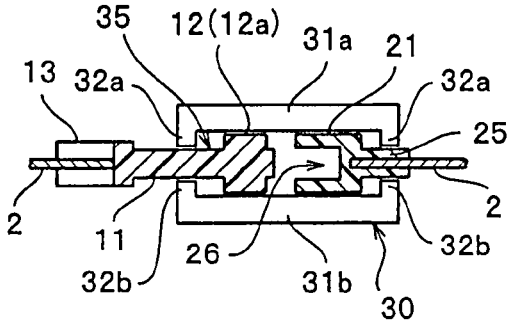
FIG. 6 is a sectional view taken along the line VI-VI of FIG. 5.

Subsequently, the to-be-pivoted portion 12 of the fitting body 10 mounted on the left side fastener stringer 6 is inserted through the shoulder mouth of the slider 30. As shown in FIG. 6, the thickness of the to-be-pivoted portion 12 is set smaller than an interval between the upper blade plate 31*a* and the lower blade plate 31*b* inside the slider 30, and the thickness of the fitting plate portion 11 is set smaller than the interval of the gap formed between the upper and lower flanges 32*a*, 32*b* of the slider 30. Consequently, the to-be-pivoted portion 12 of the fitting body 10 can be inserted easily into the element guide passage of the slider 30.

The to-be-pivoted portion 12 inserted into the element guide passage 35 passes through a space between the upper/lower flanges 32*a*, 32*b* on the fitting body 10 side and the slider holding portion 21 of the pivot stopper body 20 within the slider 30, and is inserted into and engaged with the pivot stopper portion 23 of the pivot stopper body 20 (see FIG. 3, for example). Because in this first embodiment, the intermediate portion 21 of the slider holding portion 21 is formed curvedly as described above, the to-be-pivoted portion 12 can be passed through the space between the upper/lower flanges 32*a*, 32*b* and the slider holding portion 21, thereby being inserted into the pivot stopper portion 23 stably. Consequently, the right and left fastener element rows 4 are positioned so as to allow stable coupling. Thereafter, the to-be-pivoted portion 12 of the fitting body 10 is engaged with the pivot stopper portion 23 of the pivot stopper body 20, and then, the slider 30 is slid upward, so that the slide fastener 1 can be closed like the first engagement operation.

To separate the slide fastener 1 from its closed state in this first embodiment, the slider 30 is slid from its pulled-up state toward the pivot stopper body 20 and brought into contact with the step portion 22. Subsequently, any one of two kinds of operations is carried out to allow the right and left fastener stringers 6, 6' to be separated. The two kinds of operations include: pulling out the to-be-pivoted portion 12 of the fitting body 10 engaged with the pivot stopper portion 23 of the pivot stopper body 20 from the side portion of the pivot stopper body 20 through a gap formed between the curved portion side front end 23*a* of the pivot stopper body 20 and the slider 30; and pulling out the to-be-pivoted portion 12 by causing the portion 12 to pass through the element guide passage 35 from the rear mouth of the slider 30.

Particularly, in the slide fastener 1 of the first embodiment, if the slider 30 is in contact with the step portion 22, the to-be-pivoted portion 12 of the fitting body 10 can be pulled out from the side portion of the pivot stopper body 20 by inclining the left fastener stringer 6 with respect to the right fastener stringer 6'. When the to-be-pivoted portion 12 is pulled out of the pivot stopper body 20, the right and left fastener stringers 6, 6' can be separated from each other easily as compared with a case of pulling the portion 12 through the element guide passage 35 of the slider 30.

As described above, the slide fastener 1 with a separable bottom end stop according to the first embodiment has a structure which enables the first engagement operation of achieving engagement by fitting the fitting body 10 from the side portion of the pivot stopper body 20 and the second engagement operation of achieving engagement by inserting the fitting body 10 into the pivot stopper body 20 through the element guide passage 35 of the slider 30. Thus, when closing the slide fastener 1, the user can arbitrarily select these two different engagement operations. Further, the first engagement operation enables the slide fastener 1 of the first embodiment to be closed more easily than the second engagement operation.

Accordingly, if the user is not accustomed to the first engagement operation, he or she can close the slide fastener 1 smoothly without any trouble by executing the second engagement operation. Further, by changing over from the second engagement operation to the first engagement operation, the operation of closing the slide fastener 1 can be carried out easily when he or she gets accustomed to the first engagement operation. That is, the slide fastener 1 with a separable bottom end stop of the first embodiment can be handled easily by even a user accustomed to operation of a general separable bottom end stop with an insert pin and the like and further closing or separation of the slide fastener 1 can be carried out easily by changing over the operation of the separable bottom end stop when he or she becomes accustomed to the first engagement operation as a result of continuing use of the slide fastener 1. Therefore, the slide fastener 1 of the first embodiment excels in availability and operability because ease of handling the separable bottom end stop is improved and everybody can handle it completely.

Second Embodiment

Figure 7:
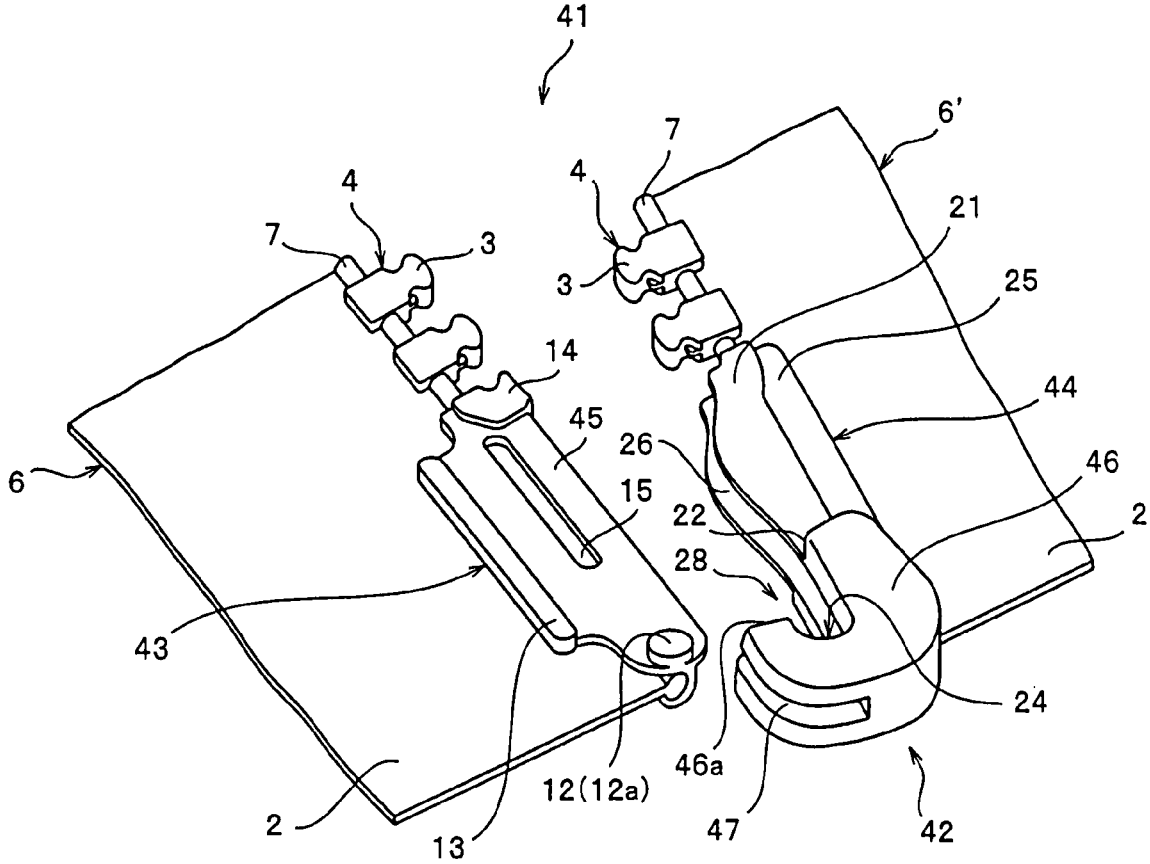
FIG. 7 is a perspective view showing major portions of a separable bottom end stop mounting portion of a slide fastener with a separable bottom end stop according to a second embodiment.

Next, a slide fastener with a separable bottom end stop according to a second embodiment of the present invention will be described with reference to the accompanying drawings. FIG. 7 is a perspective view showing major portions of a separable bottom end stop mounting portion of the slide fastener with a separable bottom end stop of the second embodiment. In the meanwhile, in description of the second embodiment and a third embodiment described later, like reference numerals are used for components having the same configuration as the first embodiment, and those components are not explained.

The slide fastener 41 with a separable bottom end stop of the second embodiment is provided with a separable bottom end stop 42 in which a fitting body 43 and a pivot stop body 44 are formed to be continuous from fastener element rows 4 at a bottom end of right and left fastener tapes 2 such that they oppose each other. In the second embodiment, the tape end portion of the fastener tape 2 having the fitting body 43 is not cut out unlike the first embodiment but the fitting body 43 is formed up to the tape end portion of the fastener tape 2.

The fitting body 43 is comprised of a fitting plate portion 45 formed flat on both the front and rear surfaces of the fastener tape 2, a to-be-pivoted portion 12 having a cylindrical pivot shaft 12*a*, a projecting portion 13, a coupling portion 14 and a recess portion 15. The fitting plate portion 45 has no notch portion 16, which is provided in the first embodiment, and the pivot shaft 12*a* is formed at the rear end portion of the fitting plate portion 45. The thickness of the fitting plate portion 45 of the fitting body 43 is smaller than the interval of a gap formed between upper and lower flanges 32*a*, 32*b* of a slider 30, and the thickness of the to-be-pivoted portion 12 is smaller than the interval in the height direction of an element guide passage 35 in the slider 30.

The pivot stopper body 44 is comprised of a slider holding portion 21, a pivot stopper portion 46 formed thicker through a step portion 22 than the slider holding portion 21, a reinforcement portion 25 and a fitting plate portion engagement groove 26. The pivot stopper portion 46 has a substantially J-shape as seen in its plan view and a substantially J-shaped inner face 24 is formed therein. The slit 47 is formed in this pivot stopper portion 46 such that it penetrates from the substantially J-shaped inner face 24 to the outer peripheral face of the pivot stopper portion 46, and the slit 47 is formed deeper than the slit 27 of the first embodiment from a curved portion front end 46*a* of the pivot stopper portion 46 along its curved shape.

The slide fastener 41 of the second embodiment having the separable bottom end stop 42 has a structure which enables a first engagement operation of fitting the to-be-pivoted portion 12 of the fitting body 43 from the side portion of the pivot stopper body 44 and a second engagement operation of inserting the to-be-pivoted portion 12 of the fitting body 43 into the pivot stopper body 44 through the element guide passage 35 of the slider 30 like the first embodiment.

Figure 8:
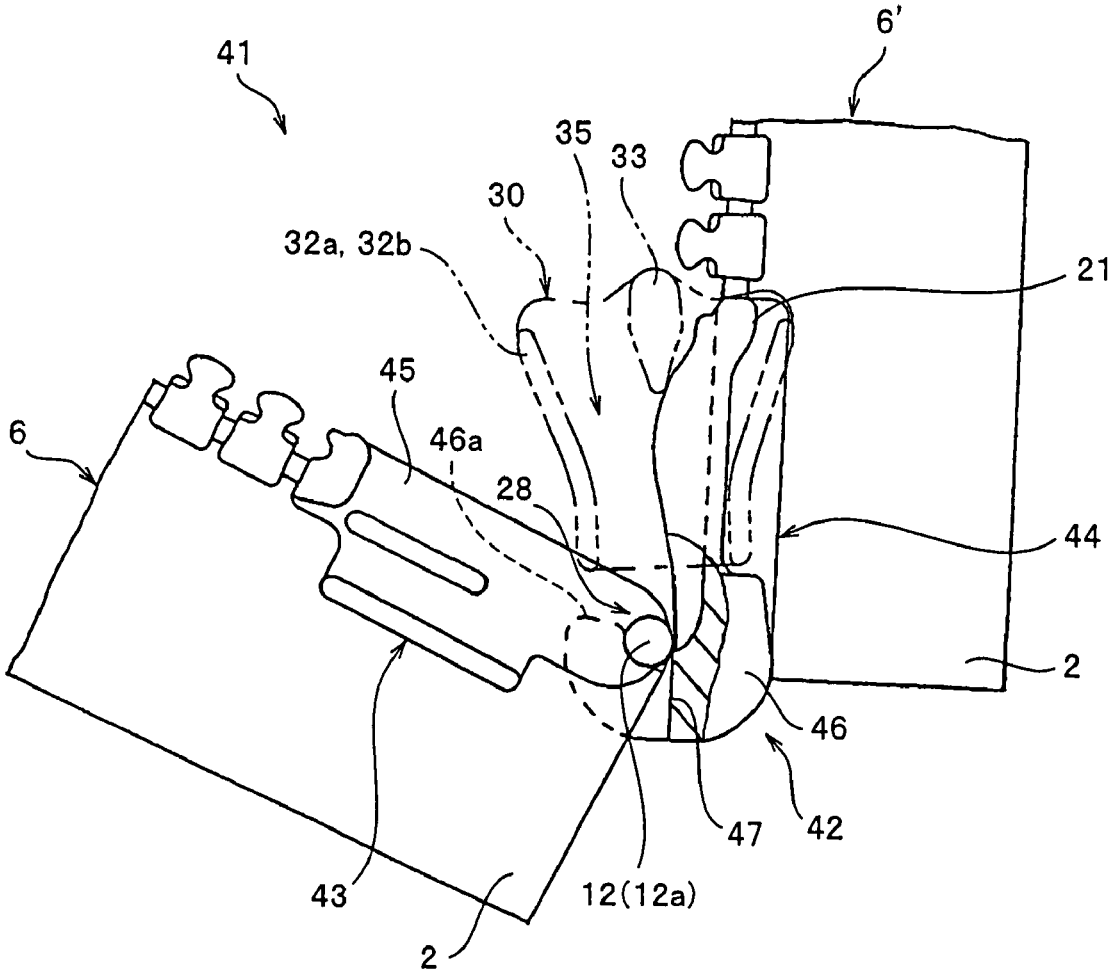
FIG. 8 is a front view schematically showing a state when the pivot shaft of the fitting body is engaged with the pivot stopper body by fitting the pivot shaft from sideway of the pivot stopper body in the first engagement operation of the slide fastener.

The first engagement operation is performed as follows in the slide fastener 41 of the second embodiment. The slider 30 is held on the slider holding portion 21 by a sliding operation, and then, the to-be-pivoted portion 12 of the fitting body 43 is fitted into the pivot space 28 from the side portion of the pivot stopper body 44, that is, through a gap formed between the curved portion side front end 46*a* of the pivot stopper portion 46 and the slider 30. With this operation, as shown in FIG. 8, the to-be-pivoted portion 12 is guided into and engaged with the pivot stopper portion 46 of the pivot stopper body 44.

Although no notch portion like in the slide fastener 1 of the first embodiment is formed in the fitting plate portion 45 of the slide fastener 41 of the second embodiment, the fitting plate portion 45 and the fastener tape 2 do not interfere with the pivot stopper portion 46 because the slit 47 is formed long from the curved portion side front end 46*a* of the pivot stopper portion 46 along the curved shape. Accordingly, the pivot shaft 12*a* of the to-be-pivoted portion 12 can be fitted easily into the curved face of the substantially J-shaped inner face 24 of the pivot stopper portion 23.

Subsequently, the fitting body 44 is rotated toward the pivot stopper body 44 around the pivot shaft 12*a* so as to insert the fitting plate portion 45 inbetween the upper and lower flanges 32*a*, 32*b* of the slider 30. Thereafter, with the fitting plate portion 45 inserted into the element guide passage 35 through the gap between the upper and lower flanges 32*a*, 32*b*, the slider 30 is slid upward so as to close the slide fastener 41.

The second engagement operation is performed as follows in the slide fastener 41 of the second embodiment. The slider 30 is held on the slider holding portion 21 by sliding toward the pivot stopper body 44, and then, the pivot shaft 12*a* of the fitting body 43 is inserted into the element guide passage 35 from the shoulder mouth of the slider 30 and engaged with the pivot stopper portion 46 of the pivot stopper body 44. Thereafter, when the slider 30 is slid upward, the slide fastener 41 can be closed.

In the second embodiment also, the first engagement operation can close the slide fastener 41 more easily than the second engagement operation. When separating the slide fastener 41 from its closed state, two kinds of operations of pulling the to-be-pivoted portion 12 from the side portion of the pivot stopper body 44 and pulling the pivot stopper portion 12 by causing the portion 12 to pass through the element guide passage 35 in the slider 30 are executed to separate the right and left fastener stringers 6, 6'.

The slide fastener 41 with a separable bottom end stop of the second embodiment allows the different two first and second engagement operations to be selected when the user closes the slide fastener 41 like the first embodiment. Therefore, ease of use of the separable bottom end stop 42 is improved largely, thereby securing excellent availability and operability, which indicates that everyone can handle it completely.

Third Embodiment

Figure 9:
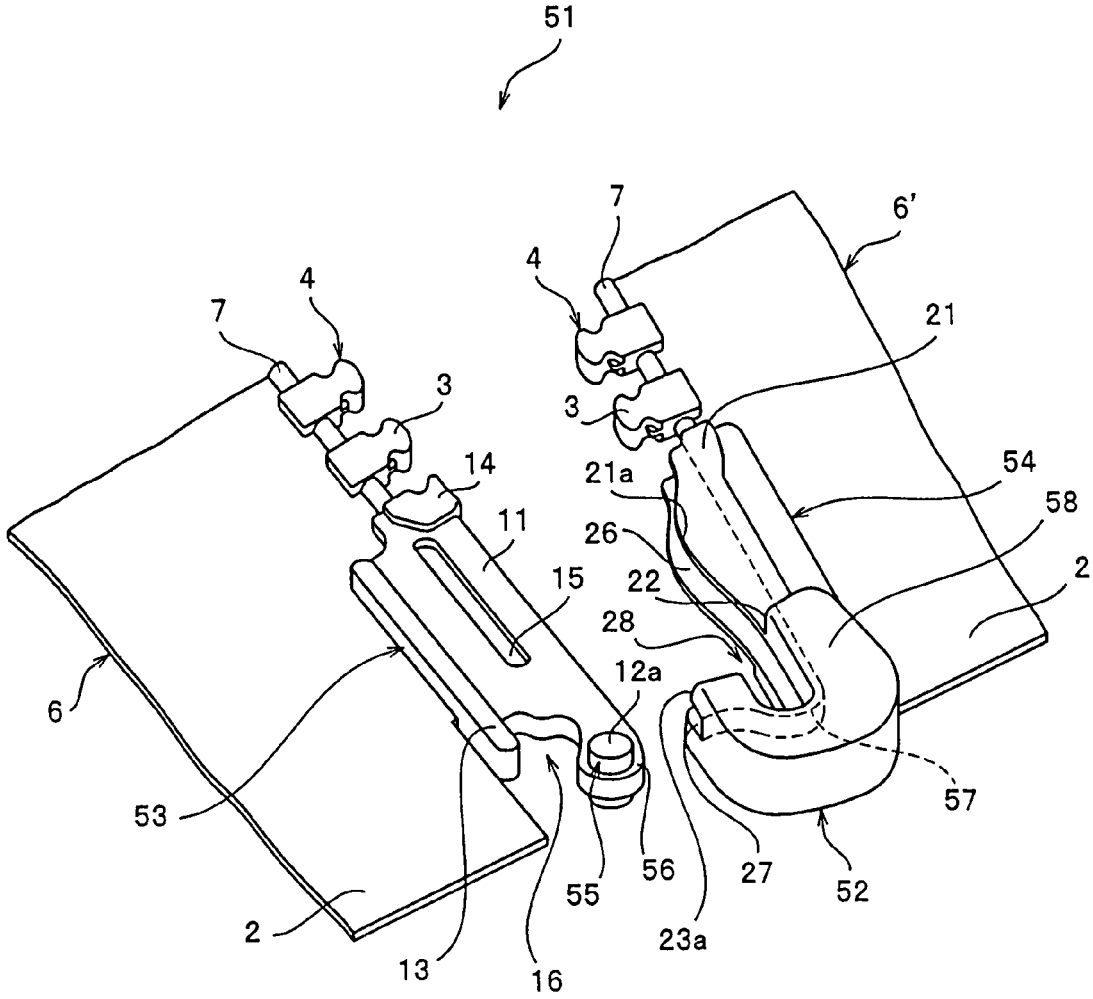
FIG. 9 is a perspective view showing major portions of a separable bottom end stop mounting portion of a slide fastener with a separable bottom end stop according to a third embodiment.

A slide fastener with a separable bottom end stop according to a third embodiment of the present invention will be described with reference to the accompanying drawings. FIG. 9 is a perspective view showing major portions of the separable bottom end stop mounting portion of the slide fastener with a separable bottom end stop of the third embodiment.

A slide fastener 51 with a separable bottom end stop of the third embodiment is provided with a separable bottom end stop 52 in which a fitting body 53 and a pivot stopper body 54 are formed continuous from fastener element rows 4 at the bottom end of right and left fastener tapes 2 such that they oppose each other.

In the third embodiment, a to-be-pivoted portion 55 of the fitting body 53 is comprised of a cylindrical pivot shaft 12*a* provided projectingly in the tape front-rear surface direction from a fitting plate portion 11 and a peripheral portion 56 provided around the pivot shaft 12*a* such that it is flush with the front and rear surfaces of the fitting plate portion 11. A to-be-pivoted portion engagement groove 57 capable of rotatably engaging the peripheral portion 56 of the to-be-pivoted portion 55 as well as the fitting plate portion engagement groove 26 capable of engaging the fitting plate portion 11 of the fitting body 53 are formed continuous from the fitting plate portion engagement groove 26 in the substantially J-shaped inner face 24 of the pivot stopper portion 58 of the pivot stopper body 54. The configuration of the third embodiment is basically the same as that of the slide fastener 1 with a separable bottom end stop of the first embodiment.

The slide fastener 51 with a separable bottom end stop of the third embodiment enables different two first and second engagement operations to be selected arbitrarily when the user closes the slide fastener 51 like the first embodiment. Thereby ease of use of the separable bottom end stop 52 is improved and excellent availability and operability are secured, so that everyone can handle it completely. Further, the peripheral portion 56 is formed on the to-be-pivoted portion 55 of the fitting body 53 and the to-be-pivoted portion engagement groove 57 capable of rotatably engaging the peripheral portion 56 is formed in the pivot stopper body 54. With this configuration, the fitting body 53 can be engaged with the pivot stopper body 54 securely when the first and second engagement operations are carried out and further, that engagement state can be maintained stably.

Fourth Embodiment

Figure 10:
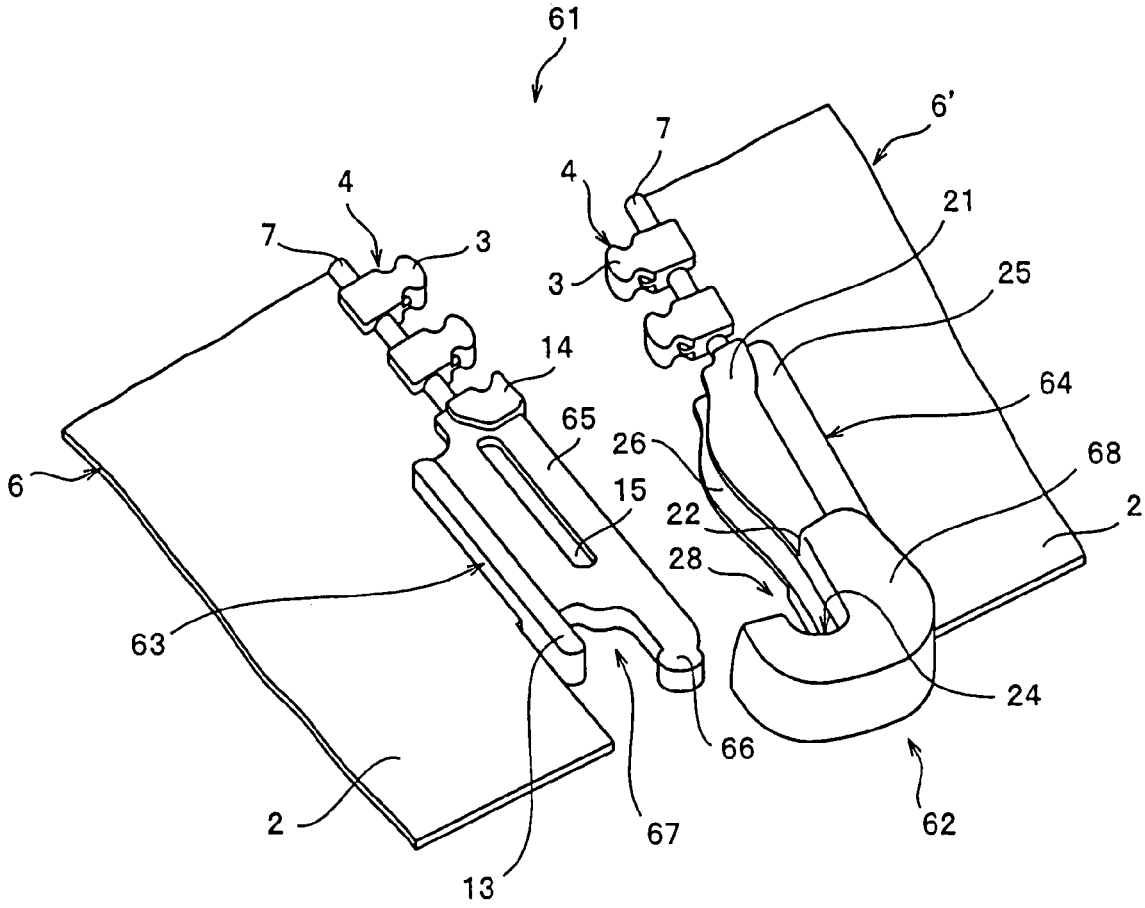
FIG. 10 is a perspective view showing major portions of a separable bottom end stop mounting portion of a slide fastener with a separable bottom end stop according to a fourth embodiment.

A slide fastener with a separable bottom end stop according to a fourth embodiment of the present invention will be described with reference to the accompanying drawings. FIG. 10 is a perspective view showing major portions of the separable bottom end stop mounting portion of the slide fastener with a separable bottom end stop of the fourth embodiment.

The slide fastener 61 with a separable bottom end stop of the fourth embodiment is provided with a separable bottom end stop 62 in which a fitting body 63 and a pivot stopper body 64 are formed continuous from fastener element rows 4 at the bottom end of right and left fastener tapes 2 such that they oppose each other.

The fitting body 63 is comprised of a fitting plate portion 65 formed flat on both the front and rear surfaces of the fastener tape 2, a circular to-be-pivoted portion 66 formed at the rear end portion of the fitting plate portion such that it is flush with the front and rear surfaces of the fitting plate portion 65, a projecting portion 13, a coupling portion 14 and a recess portion 15. In the fourth embodiment, the thickness of the fitting plate portion 65 is smaller than the interval of a gap between upper and lower flanges 32*a*, 32*b* of a slider 30. The to-be-pivoted portion 66 has the same thickness as the fitting plate portion 65, and the thickness of the to-be-pivoted portion 66 is small than the height of the element guide passage 35 in the slider 30 and further smaller than the interval of the gap formed between the upper and lower flanges 32*a*, 32*b*.

In the fourth embodiment, part of a tape end side of the fastener tape 2 having the fitting body 63 is cut out like the first embodiment, and the fitting plate portion 65 is extended backward in this portion having no fastener tape. Further, a notch portion 67 which is cut inward of the tape from the tape end side is formed in the fitting plate portion 65 deeper than the first embodiment.

The pivot stopper body 64 is comprised of a slider holding portion 21, a pivot stopper portion 68 formed thicker than the slider holding portion 21 via a step portion 22, a reinforcement portion 25 and a fitting plate portion engagement groove 26. The pivot stopper portion 68 is formed in substantially J shape as seen in its plan view like the first and second embodiments and has a substantially J-shaped inner face 24. On the other hand, the pivot stopper portion 68 has no slit which is formed in the first and second embodiments.

The slide fastener 61 of the fourth embodiment having the separable bottom end stop 62 has a structure which enables a first engagement operation of fitting the to-be-pivoted portion 66 of the fitting body 63 from the side portion of the pivot stopper body 64 and a second engagement operation of inserting the to-be-pivoted portion 66 of the fitting body 63 into the pivot stopper body 64 through the element guide passage 35 of the slider 30 like the first and second embodiments.

The first engagement operation is performed as follows in the slide fastener 61 of the fourth embodiment. The slider 30 is held on the slider holding portion 21 by sliding operation, and then, the to-be-pivoted portion 66 of the fitting body 63 is fitted from the side portion of the pivot stopper body 64 and guided into the pivot space 28 in the pivot stopper portion 68 and engaged with the substantially J-shaped inner face 24. In the slide fastener 61 of the fourth embodiment, the deep notch portion 67 is formed in the fitting plate portion 65 of the fitting body 63 although no slit like in the first and second embodiment is formed in the pivot stopper portion 68. With this configuration, the fitting plate portion 65 does not interfere with the pivot stopper portion 68, so that the to-be-pivoted portion 66 can be fitted into and engaged with the pivot stopper portion 68 easily.

Figure 11:
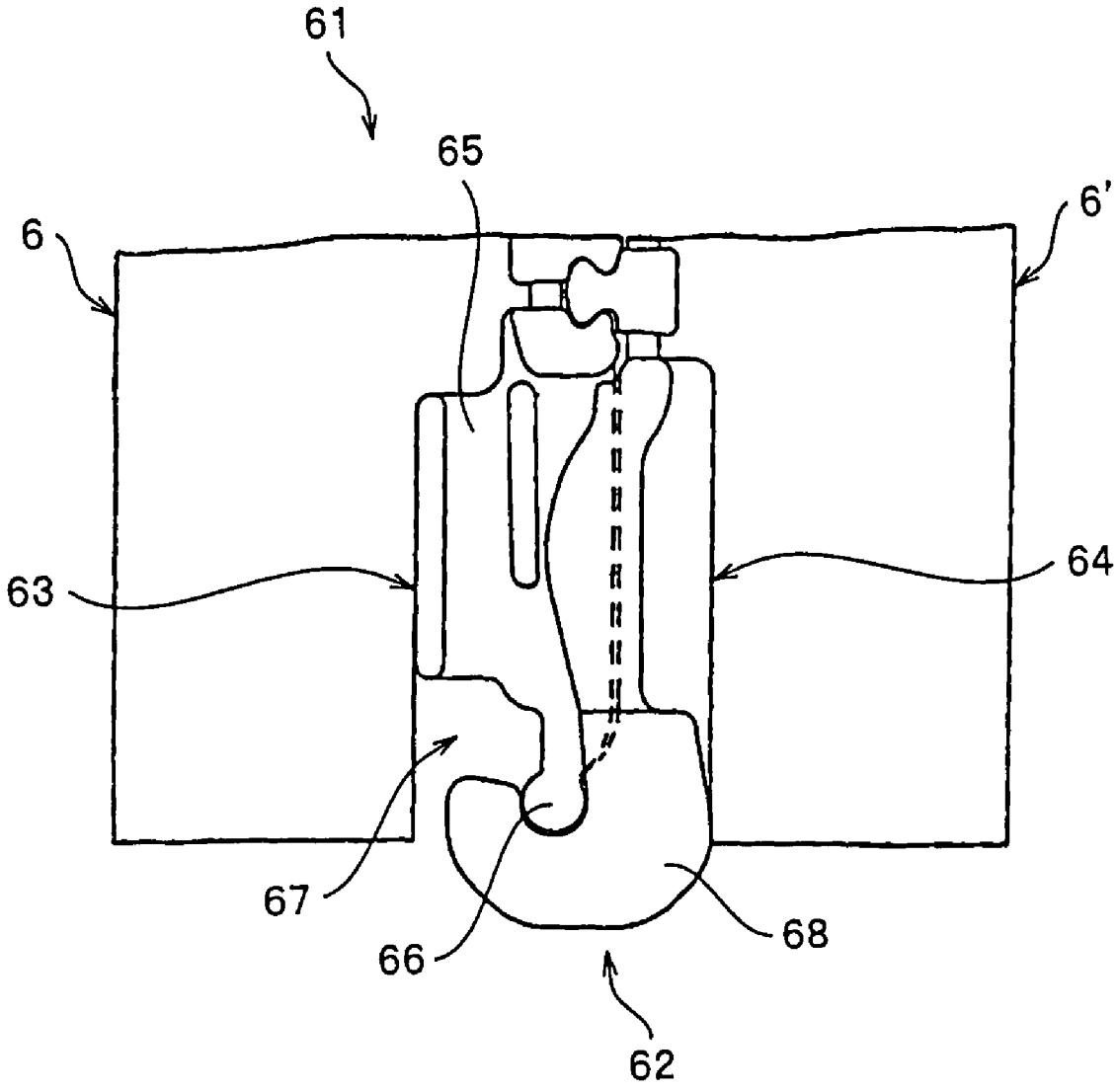
FIG. 11 is a front view schematically showing a closed condition of the slide fastener with a separable bottom end stop according to the fourth embodiment.

Subsequently, the fitting body 63 is rotated toward the pivot stopper body 64 around the to-be-pivoted portion 66 so as to insert the fitting plate portion 65 into the element guide passage 35 through the upper and lower flanges 32*a*, 32*b* of the slider 30. Thereafter, with the fitting plate portion 65 inserted in between the upper and lower flanges 32*a*, 32*b*, the slider 30 is slid upward so as to close the slide fastener 61 (see FIG. 11).

The second engagement operation is performed as follows in the slide fastener 61 of the fourth embodiment. The slider 30 is held on the slider holding portion 21 by sliding, and then, the to-be-pivoted portion of the fitting body 63 is inserted into the interior of the element guide passage 35 of the slider 30 and engaged with the pivot stopper portion 68 of the pivot stopper body 64. Thereafter, the slide fastener 61 can be closed by sliding the slider 30 upward.

In the fourth embodiment, when executing the first engagement operation, the to-be-pivoted portion 66 can be inserted into the element guide passage 35 through the gap formed between the upper and lower flanges 32*a*, 32*b* arranged on the fitting body 63 side of the slider 30 as well as from the shoulder mouth in the slider 30 because the to-be-pivoted portion 66 of the fitting body 63 is formed in a smaller thickness than the interval of the gap formed between the upper and lower flanges 32*a*, 32*b*. Consequently, operability of the second engagement operation can be improved.

As described above, the slide fastener 61 with a separable bottom end stop of the fourth embodiment can select any one of the different two engagement operations, the first and second engagement operations when closing the slide fastener 61 like the first embodiment. Consequently, ease of use of the separable bottom end stop 62 is improved largely and excellent availability and operability are secured, so that everyone can handle it completely.

Fifth Embodiment

Figure 12:
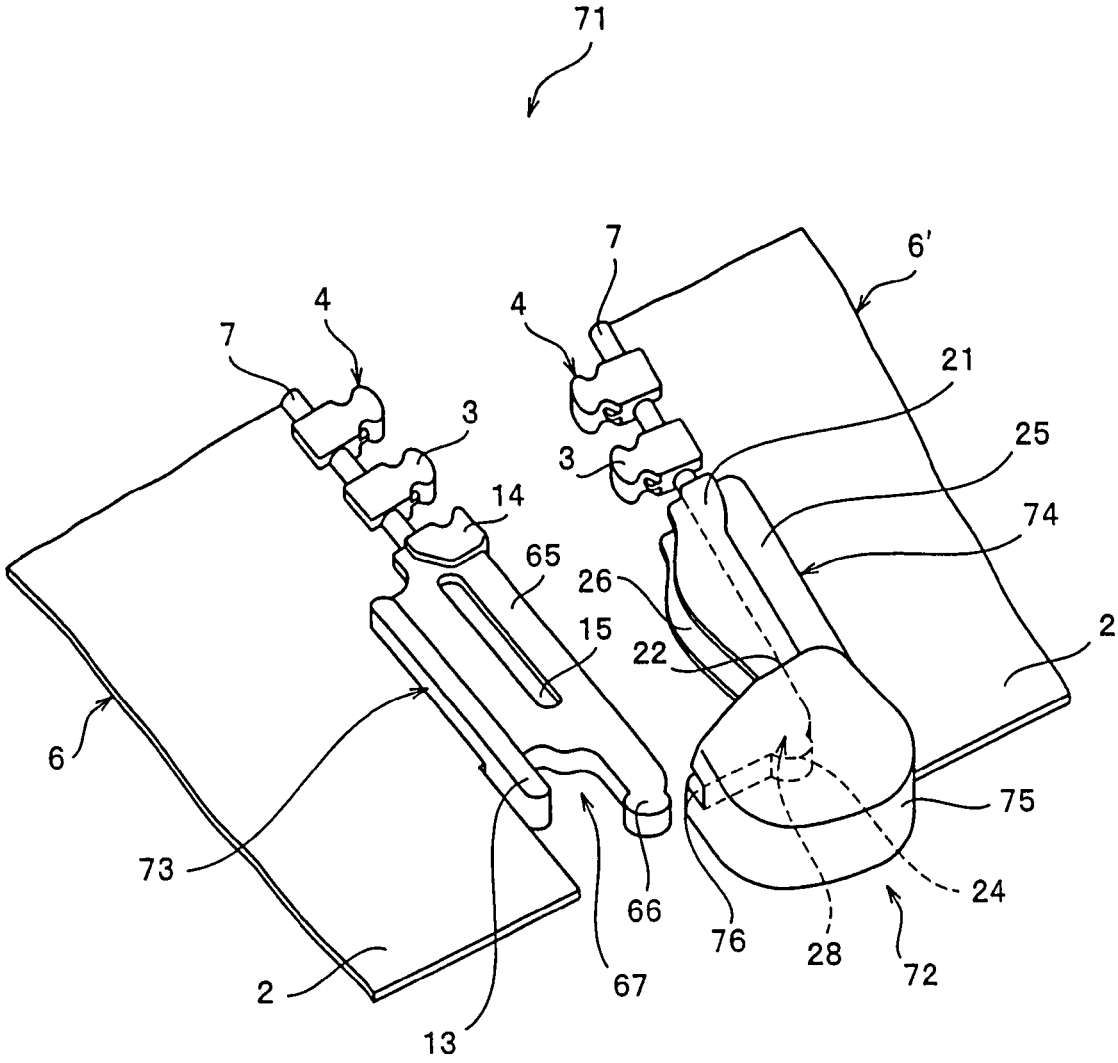
FIG. 12 is a perspective view showing major portions of a separable bottom end stop mounting portion of a slide fastener with a separable bottom end stop according to a fifth embodiment.

A slide fastener with a separable bottom end stop of the fifth embodiment of the present invention will be described with reference to the drawings. FIG. 12 is a perspective view showing major portions of a separable bottom end stop mounting portion of the slide fastener with a separable bottom end stop of the fifth embodiment.

A slide fastener 71 with a separable bottom end stop of the fifth embodiment is provided with a separable bottom end stop 72 in which a fitting body 73 and a pivot stopper body 74 are formed continuous from fastener element rows 4 at the bottom end of right and left fastener tapes 2 such that they oppose each other.

The fitting body 73 of the fifth embodiment has the same configuration as the fitting body 63 of the fourth embodiment. On the other hand, the pivot stopper body 74 has a slider holding portion 21, a pivot stopper portion 75 formed thicker than the slider holding portion 21 via a step portion 22, a reinforcement portion 25, and a fitting plate portion engagement groove 26. The pivot stopper portion 75 is formed in a substantially rectangular shape and incorporates internally a slit 76 through which a fitting plate portion 65 and a to-be-pivoted portion 66 can be inserted, a slit-like pivot space 28 in which the to-be-pivoted portion of the fitting body 73 can be fitted, and a substantially J-shaped inner face 24 which is capable of engaging the to-be-pivoted portion 66 fitted into the pivot space 28 rotatably. In the meantime, in the fifth embodiment, as shown in FIG. 12, the slit 76 and the pivot space 28 are constituted integrally.

The slide fastener 71 with a separable bottom end stop of this fifth embodiment allows the user to select any one of the different two engagement operations, the first and second engagement operations when closing the slide fastener 71 like the first embodiment. Consequently, ease of use of the separable bottom end stop 72 is improved largely and its availability and operability are excellent, so that everyone can handle it completely. Additionally, in the slide fastener 71 of the fifth embodiment, even if the slide fastener 71 receives a push-up force when it is closed, the engagement condition between the fitting body 73 and the pivot stopper body 74 can be maintained stably. This is because when the fitting body 73 is engaged with the pivot stopper body 74, the to-be-pivoted portion 66 can be engaged with the substantially J-shaped inner face 24 by fitting into the pivot space 28 formed in the pivot stopper portion 75.

What is claimed is:

1. A slide fastener with a separable bottom end stop, including:

a slider through which fastener element rows pass, the fastener element rows mounted on opposing side edges of a pair of right and left fastener tapes; and the separable bottom end stop including a fitting body which is provided at an end portion of the fastener element row of one of the fastener tapes and has a to-be-pivoted portion, and a pivot stopper body which is provided on an end portion of the fastener element row of the other fastener tape, is capable of engaging with or disengaging from the to-be-pivoted portion of the fitting body, and functions as a bottom end stop of the slider, the slider having a guide post, an upper blade plate and a lower blade plate connected by the guide post, flange portions erected from right and left side edges of the upper blade plate and/or the lower blade plate, and a Y-shaped element guide passage which is surrounded by the upper blade plate, the lower blade plate and the flange portions and is branched to two sections by the guide post from a rear mouth to a shoulder mouth of the slider, wherein the pivot stopper body has a pivot stopper portion which is capable of rotatably engaging with the to-be-pivoted portion by fitting the to-be-pivoted portion in the pivot stopper portion from a side portion of the pivot stopper body, and a thickness of the to-be-pivoted portion in a tape front-rear surface direction is set smaller than an interval between the upper blade plate and the lower blade plate, and the pivot stopper portion is capable of rotatably engaging with the to-be-pivoted portion by inserting the to-be-pivoted portion in the pivot stopper portion through the element guide passage from the shoulder mouth of the slider the fitting body has a thin fitting plate portion which is formed integrally on both front and rear surfaces of one of the fastener tapes and which has the to-be-pivoted portion arranged at a tape end side front portion of the thin fitting plate portion, the pivot stopper body has a slider holding portion which is formed integrally on both front and rear surfaces of the other fastener tape and holds the slider, the pivot stopper portion is formed so as to be thick on a tape end side of the slider holding portion via a step portion; includes a substantially J-shaped inner face which is extended from the slider holding portion to the tape end side and curved toward a side of the fitting body and a pivot space which allows the to-be-pivoted portion to be fitted into the substantially J-shaped inner face from a side portion of the pivot stopper body; and is capable of engaging with the to-be-pivoted portion to the substantially J-shaped inner face, and a thickness of the thin fitting plate portion is set smaller than the interval of a gap provided on the flange portion of the slider.

2. The slide fastener with a separable bottom end stop according to claim 1, wherein the to-be-pivoted portion has a cylindrical pivot shaft provided projectingly in a tape front-rear surface direction from the thin fitting plate portion.

3. The slide fastener with a separable bottom end stop according to claim 1, wherein the to-be-pivoted portion is formed in a circular shape such that it is flush with front and rear surfaces of the thin fitting plate portion.

4. The slide fastener with a separable bottom end stop according to any one of claims 1,2, or 3, wherein a fitting plate portion engagement groove which allows the thin fitting plate portion to be fitted therein is formed in a side face of the slider holding portion opposing the thin fitting plate portion.

5. The slide fastener with a separable bottom end stop according to claim 1, wherein a to-be-pivoted portion engagement groove which allows the to-be-pivoted portion to be fitted therein is formed in the substantially J-shaped inner face of the pivot stopper portion, and the to-be-pivoted portion engagement groove constitutes the pivot space.

6. The slide fastener with a separable bottom end stop according to claim 1, wherein the pivot stopper portion has a slit which penetrates from the substantially J-shaped inner face to an outer peripheral face, and a groove width of the slit is set larger than a thickness of the thin fitting plate portion.

7. The slide fastener with a separable bottom end stop according to claim 1, wherein the thin fitting plate portion has a notch portion which is cut from a tape end side of the thin fitting plate portion toward an inward of the tape.

8. The slide fastener with a separable bottom end stop according to claim 4, wherein the fitting plate portion engagement groove is formed in part of the substantially J-shaped inner face of the pivot stopper portion.

* * * * *